United States Patent [19]

Schwartz

[11] 4,343,032

[45] Aug. 3, 1982

[54] LIGHT SENSITIVE ELECTRICAL DEVICE

[75] Inventor: Frederic W. Schwartz, Providence, R.I.

[73] Assignee: Cable Electric Products, Inc., Providence, R.I.

[21] Appl. No.: 923,057

[22] Filed: Jul. 10, 1978

[51] Int. Cl.[3] ..... F21V 23/04

[52] U.S. Cl. ..... 362/276; 362/147; 362/308; 362/332; 362/802

[58] Field of Search ..... 362/2, 20, 195, 197, 362/308, 802, 806, 276, 332

[56] References Cited

U.S. PATENT DOCUMENTS

| | | | |
|---|---|---|---|
| 3,724,931 | 4/1973 | Nevyas | 362/802 X |
| 3,739,226 | 6/1973 | Seiter et al. | 362/20 X |
| 3,751,711 | 8/1973 | Schick | 362/802 X |
| 3,870,873 | 3/1975 | Mallory | 362/2 |
| 4,177,500 | 12/1979 | Nicholl et al. | 362/20 |

OTHER PUBLICATIONS

Markus, John, Guidebook of Electronic Circuits, McGraw-Hill Book Co., 1974, p. 389.

*Primary Examiner*—Peter A. Nelson
*Attorney, Agent, or Firm*—Paul J. Sutton

[57] ABSTRACT

A housing having means for connecting to a conventional electric outlet. The housing is provided with a lower portion having a printed circuit and a transparent lens. The circuit includes a photo conductive cell sensitive to the light through the lens. The cell is designed to become more conductive in the dark and less conductive in daylight, gradually fading from one condition to the other. The circuit also includes an electric light mounted in the upper portion of the housing and covered by a transluscent shade. Current to the light is passed through a Quadrac which is activated by a connection between its gate and the photo cell. As the light fades in the room, the photo cell transmits more and more current to the quadrac gate and the light gradually gets brighter and brighter. This makes a fine auxiliary light in a bathroom or similar location in the home since it is small and compact.

3 Claims, 6 Drawing Figures

LIGHT SENSITIVE ELECTRICAL DEVICE

BACKGROUND OF THE INVENTION

Night lights are provided for lighting in dark places around a home such as stairs, children's rooms, bathrooms, etc. However, these must be manually switched on or left to burn continuously. While switching devices have been used sensitive to light, these are primarily for outdoor use, street lights and the like, and the switches are comparatively bulky and costly for indoor use. The advent of the printed circuit and the invention of the various solid state devices have permitted heretofor large circuits to be considerably reduced in size.

SUMMARY OF THE INVENTION

The present invention provides a comparatively small, compact unit which can readily be used in the home. The unit is no larger than a conventional night light, utilizing a simple printed circuit arrangement. The unit can be plugged into a wall outlet either directly or provided with an extension cord for the purpose. The unit comprises a housing having a lower portion for the printed circuit board and having a transparent lens. The circuit includes a photo conductive cell sensitive to the light passing through the lens. The cell is virtually non-conductive in daylight or any other light and gradually becomes more conductive as the light fades into darkness. An electric light is mounted in the upper portion of the housing and covered with a transluscent shade. Current to the light is controlled by the gate of a quadrac. The photo cell passes the current to the gate which triggers the current to the light. Thus, as the room gets dark, the photo cell allows more and more current to flow to the gate and the light will gradually get brighter and brighter.

DESCRIPTION OF THE INVENTION

The light sensitive device of the present invention is provided with a lower housing portion 10 of a generally rectangular form. At the front of the housing portion 10, a transparent lens 12 is mounted. At the rear of the portion 10, the device can be provided with the conventional contact blades 14 for plugging the device directly into a wall outlet, or the device can be provided with an extension cord for the purpose as shown in dotted lines 16 in FIG. 5.

Figure 1:
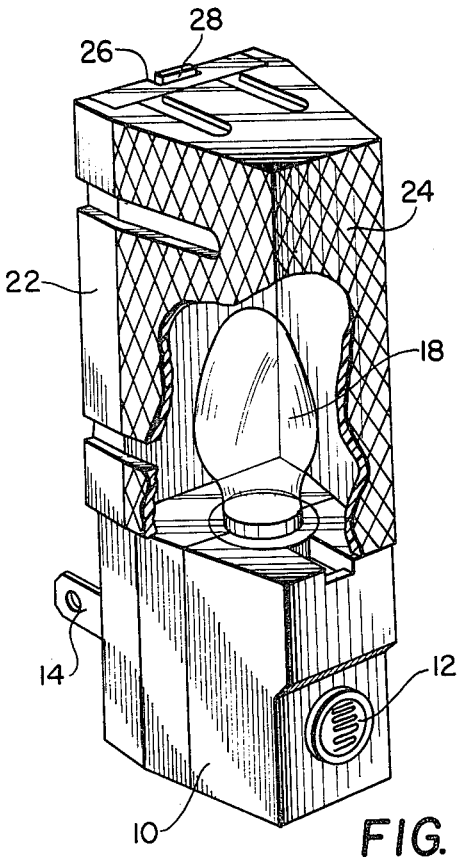
FIG. 1 is a perspective view, partially broken away, of a light sensitive device embodying my present invention.
Figure 2:
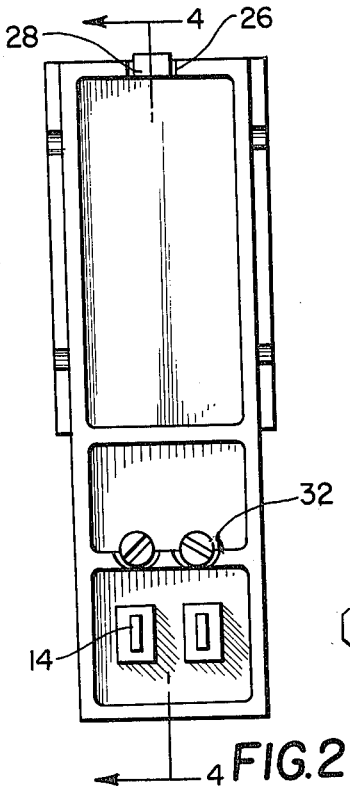
FIG. 2 is a rear view thereof.
Figure 3:
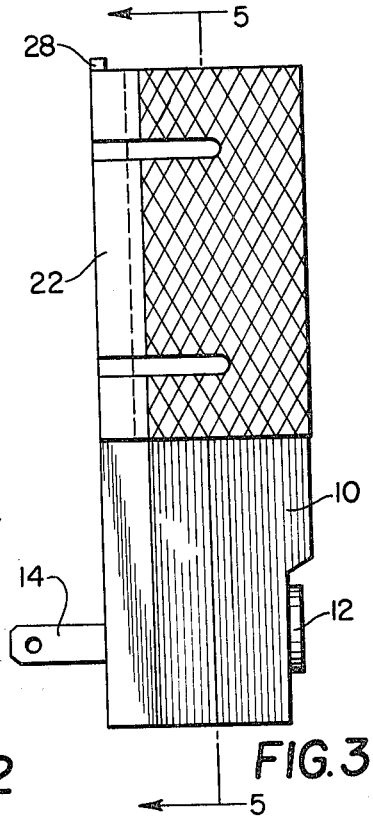
FIG. 3 is a side elevation thereof.

Mounted on top of the lower housing portion 10 is an electric lamp or light 18 which is screwed into the socket portion 20. At the rear, the wall of the housing extends upwardly above the light 18 to form an upper rear wall portion 22. I now provide a transluscent plastic shade 24 open at the rear and bottom and having a generally rectangular shape conforming to the bottom housing 10. The wall portion 22 is provided at the top rear edge with a small cut out 26 and the shade 24 is provided at the upper rear with an integral upstanding tab 28. To mount the shade, the upper end is slanted inwardly until the tab 28 enters the cut out 26, the bottom of the shade is then swung inwardly to frictionally snap into the position shown in FIGS. 1 and 3.

Figure 4:
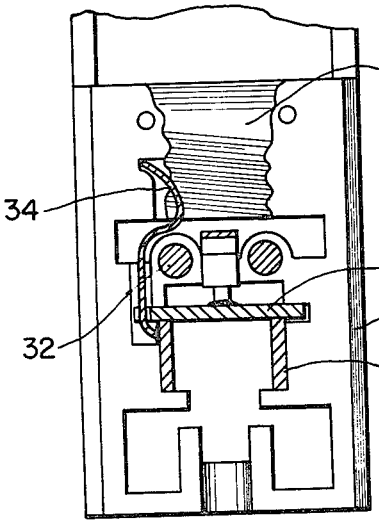
FIG. 4 is a section taken on line 4—4 on FIG. 2.
Figure 5:
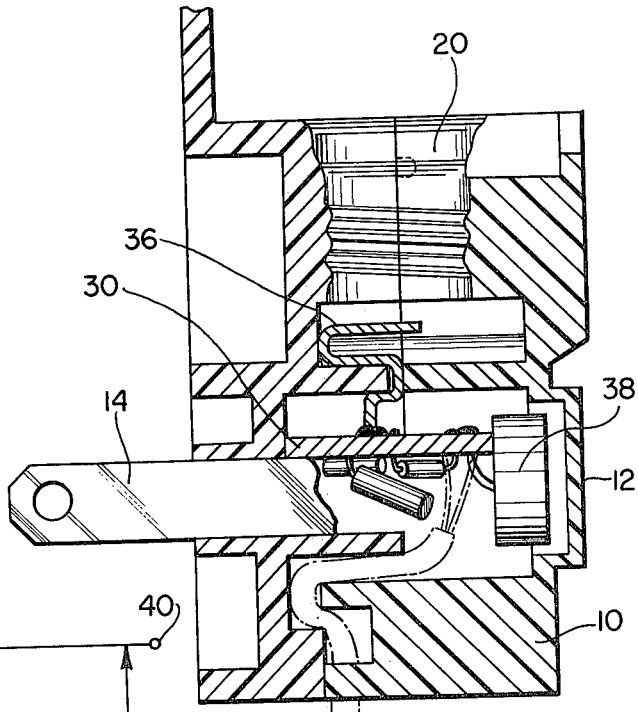
FIG. 5 is a section taken on line 5—5 on FIG. 3.

A printed circuit board 30 is mounted in the lower housing portion 10 and contrained by the molded configuration 32. Viewing FIGS. 4 and 5, the current to the electric light 18 is provided from one contact by the metal strip 34 extending to one side of the socket portion 20, and the U-shaped strip 36 at the bottom of the socket portion adapted to contact the bottom end of the light bulb 18. FIG. 5 also shows the cds (cadmium sulfide) photo conductive cell 38 mounted on the board 30 directly behind the transparent lens 12.

Figure 6:
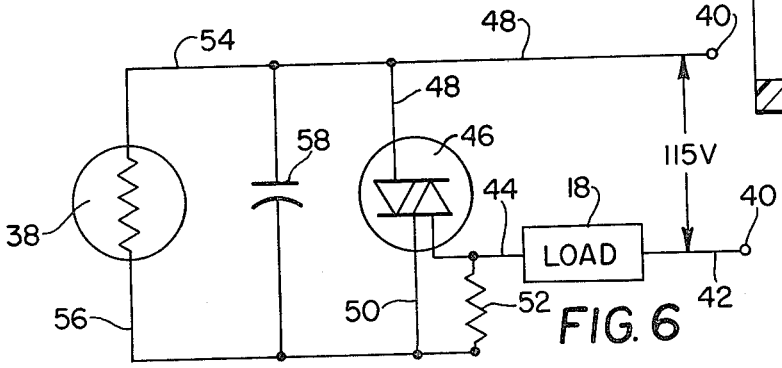
FIG. 6 is a diagram of the electric circuitry.

Operation of the device is in accordance with the diagram shown in FIG. 6, mostly mounted on the printed circuit board 30. The device is plugged into a source of alternating current, 115 v., at 40. The ground portion of the line, 42, leads to the "load", which in this case is the electric light 18. The other side of the light 18 leads through the line 44 to a quadrac 46. The quadrac 46 leads through the line 48 back to the hot side of the current supply source 40. The current to the light 18 is thus controlled by the quadrac which in turn is triggered through the line 50 leading to the gate. The line 50 also has a resistor 52 extending to the line 44 as a safety bypass to prevent damage to the parts in the event the light 18 burns out.

The current to the gate 50 is controlled by the cds photo conductive cell 38. The power line 48 is extended at 54 to one side of the cell 38 and the other side is connected by a line 56 to the gate line 50. A capacitor 58 is mounted across the lines 54 and 56. To trigger the quadrac 46, the photo cell 38 allows the current to flow from the lines 48 and 54 to line 56 and the gate line 50 as the room darkens. This triggers the quadrac 46 to allow the current to flow through lines 48 and 44 through the light 18.

Thus the simple and compact circuit serves to control the light 18 and cause it to increase in brightness as the room darkens. No manual switching is necessary since the cds photo cell 38 effectively controls the current. The entire device is no larger than a conventional night light but much more efficient. The housing is readily moldable from a dielectric plastic and assembly is simple and easy. The entire unit is comparatively inexpensive to manufacture and assembly. Its uses are many as it is more than a night light and will operate unattended. Note that the device can be used to trigger other "loads" by merely screwing a plug into the socket instead of the light, and leading the current from the plug through a cord lead wire to any other electrical device within allowable current parameters.

Other advantages of the present invention will be readily apparent to a person skilled in the art.

I claim:

1. A portable light-sensitive electrical device capable of being used with and movable between one or more of a number of spaced existing conventional electrical receptacles of the type normally found mounted in walls, or the like, comprising in combination: a housing having front, rear, side, top and bottom wall portions, an electrical circuit carried within said housing, blade means electrically connected to said circuit with portions thereof extending from said housing for removably matingly engaging and being physically mounted to contacts of an electrical receptacle, lamp-receiving socket means electrically cooperative with said circuit and whose substantially sole source of current is from said receptacle, and light-sensitive means carried by said housing and disposed so as to be able to receive ambient light for controlling current flow from one of said receptacle contacts to said socket means, allowing more current flow to said socket means as ambient light received by said light-sensitive means decreases and lesser current flow to said socket means as said received light increases, said device being characterized by the absence of need for a power source other than that to which it is connected and wherein said housing does not cover the receptacle openings and surrounding receptacle portions of the unused receptacle of a duplex receptacle to which the device is connected, said light sensitive means including a photo conductive cell, said device including an electric light bulb with portions thereof mounted in said socket and a shade of predetermined shape and appearance, said shade comprising front and side wall portions, said front wall portion having a generally planar surface extending between generally rectangular edges including longer vertically extending edges and relatively shorter horizontally extending edges, said side wall portions extending in a diverging manner generally symmetrically at a predetermined angle greater than 90 degrees away from said front wall portion toward a rearward plane of said housing, said shade being formed with at said front wall portion with a generally polygonal-shaped pattern extending over substantially the entire front wall portion, said shade further comprising bottom means capable of being swung inwardly to frictionally engage and disengage in a snap-on manner and be mounted to said housing in a position with respect to said housing illustrated in FIG. 1 of the drawing, said shade engagement and disengagement with said housing facilitating repeated replacement of said bulb.

2. A device according to claim 1 wherein said device is characterized by the absence of need for a power source other than that to which it is connected.

3. A device according to claim 1 wherein said housing does not cover the receptacle openings and surrounding receptacle portions of the unused receptacle of a duplex receptacle to which the device is connected.

* * * * *